US006135673A

United States Patent [19]

Horton, III et al.

[11] Patent Number: 6,135,673

[45] Date of Patent: Oct. 24, 2000

[54] METHOD/APPARATUS FOR ASSEMBLING A FLOATING OFFSHORE STRUCTURE

[75] Inventors: Edward E. Horton, III, Houston; Jun Chung Chao, Katy, both of Tex.

[73] Assignee: Deep Oil Technology, Incorporated, Houston, Tex.

[21] Appl. No.: 09/100,285

[22] Filed: Jun. 19, 1998

[51] Int. Cl.[7] ..... E02B 17/00

[52] U.S. Cl. ..... 405/205; 114/264

[58] Field of Search ..... 405/204, 205, 405/209, 206; 114/125, 264, 265

[56] References Cited

U.S. PATENT DOCUMENTS

| | | | |
|---|---|---|---|
| 3,837,309 | 9/1974 | Biewer | 114/265 |
| 4,167,148 | 9/1979 | Fayren | 114/265 |
| 5,609,442 | 3/1997 | Horton | 405/205 |

*Primary Examiner*—Eileen D Lillis
*Assistant Examiner*—Sunil Singh
*Attorney, Agent, or Firm*—Robert J. Edwards; D. Neil LaHaye

[57] ABSTRACT

A method and apparatus for rapidly deballasting and lifting a substructure in a marine environment to a level where it will engage with a deck so that both act together as one body. Generally, the installation is carried out as follows. The substructure is towed to the mating site and upended (if necessary). The substructure may be connected to a temporary mooring and fixed ballast installed if necessary. Selected compartments in the substructure are filled with sea water until the substructure is submerged below the water line to a desired depth. A predetermined quantity of compressed air is pumped into lower tanks in the substructure. The deck to be joined with the substructure is positioned above and in alignment with the substructure. The proper valves are opened to allow the compressed air in the lower tanks to flow into the upper tanks that contain sea water. The compressed air displaces the sea water from the upper tanks. This increases the buoyancy of the substructure and causes it to move upward into contact with the deck. As the process continues, the deck and substructure will eventually act as one body.

5 Claims, 14 Drawing Sheets

METHOD/APPARATUS FOR ASSEMBLING A FLOATING OFFSHORE STRUCTURE

BACKGROUND OF THE INVENTION

1. Field of the Invention

The invention is generally related to the installation of decks on offshore structures and more particularly to the assembly of floating offshore structures.

2. General Background

In the offshore drilling industry, unlike ships which can be fully assembled at an inshore facility, many types of oil drilling or production facilities require part of the assembly to take place either at the field location itself or afloat prior to towing to the installation site. For example, it is, by the nature of the design of jacket type production platforms, that the production deck (topsides) be installed after the jacket has been installed and piled to the sea floor. The topsides are typically installed in one or more pieces using heavy lift marine cranes. This can be a costly and weather sensitive operation. Also, additional cost is incurred due to the additional logistical support for the final hook-up of the topsides to the platform which must then take place offshore. The offshore hook-up problem is further aggravated if the topsides requires several lifts and/or the production platform is in a remote location.

Concrete GBS production platforms and floating production platforms such as Spar Platforms can provide the option, due to their buoyancy capacity, of avoiding the cost associated with offshore heavy lift operations by allowing a "float over" deck installation operation. Using this prior art method, a fully completed deck is loaded on barges in a catamaran configuration, the platform is ballasted down to a reduced freeboard, and the topsides floated over the platform. The platform is deballasted, thereby picking up the topsides and lifting it to the proper elevation above the water line. However, the transport of the topsides and the mating operation itself must take place in fairly benign conditions.

Due to the large draft of Spar type platforms, the traditional construction sequence, for steel hull Spars, involves the joining of structural sections in the horizontal position, followed by upending of the entire Spar hull to the vertical position. The structural sections may consist of either plated hull tank sections only, or a combination of plated tank and truss type sections. Such Spar type platforms are described in U.S. Pat. Nos. 4,702,321 and 5,558,467. As a consequence of a horizontal assembly and upending sequence, the topsides can only be installed after the upending operation and thus must take place in a location with substantial water depth. This can result, depending on geographical location, in either:

- the topsides having to be installed offshore in a non-sheltered area, which means the deck transport and installation become weather sensitive operations; or possibly require a long tow of the fully assembled Spar to the production site, if the risk of an offshore deck installation is too high and the topsides must be installed in a sheltered location.

Pending U.S. patent application assigned Ser. No. 08/931,461 discloses a method for assembling a floating offshore structure wherein raising the hull to bring it into engagement with the deck structure is accomplished by winching or deballasting or a combination of both. The deballasting is accomplished through the use of control lines connected between the hull and a surface vessel. The control lines are used to inject air, from compressors on a support vessel, into ballast tanks to expel water ballast in the tanks.

U.S. Pat. No. 5,403,124 discloses a manner of installing a full sized deck upon a substructure wherein a semi-submersible vessel supporting a deck is ballasted down to lower the deck into engagement with the substructure or hull.

The problem with known deck installation systems, including the pending application referred to above, is that they do not provide a means for rapidly lifting the hull to a level where it will act as one body together with the deck. Unless this is done rapidly, the deck will bang repeatedly on the top of the hull and possibly cause damage until the hull develops sufficient buoyancy to raise it enough so that the two bodies (deck and hull) behave as one in the seaway. In order to achieve this change of displacement, water ballast pumps would need to be very large and these would have to be coupled with large diameter pipes to accommodate the flow. Alternatively, the use of air compressors alone would require very high capacity compressors.

It can be seen that the present state of the art in the installation of topsides on a floating offshore structure such as a Spar type hull includes shortcomings which have not been adequately addressed.

SUMMARY OF THE INVENTION

The invention addresses the above shortcomings. What is provided is a method and apparatus for rapidly deballasting and lifting a substructure in a marine environment to a level where it will engage with a deck so that both act together as one body. Generally, the installation is carried out as follows. The substructure is towed to the mating site and upended (if necessary). The substructure may be connected to a temporary mooring and fixed ballast installed if necessary. Selected compartments in the hull are filled with sea water until the upper end of the substructure is submerged below and near the water line to a desired depth. A predetermined quantity of compressed air is pumped into lower tanks in the substructure. The deck to be joined with the substructure is positioned above and in alignment with the substructure. The proper valves are opened to allow the compressed air in the lower tanks to flow into the upper tanks that contain sea water. The compressed air displaces the sea water from the upper tanks. This increases the buoyancy of the substructure and causes it to move upward into contact with the deck. As the process continues, the deck and substructure will eventually act as one body.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
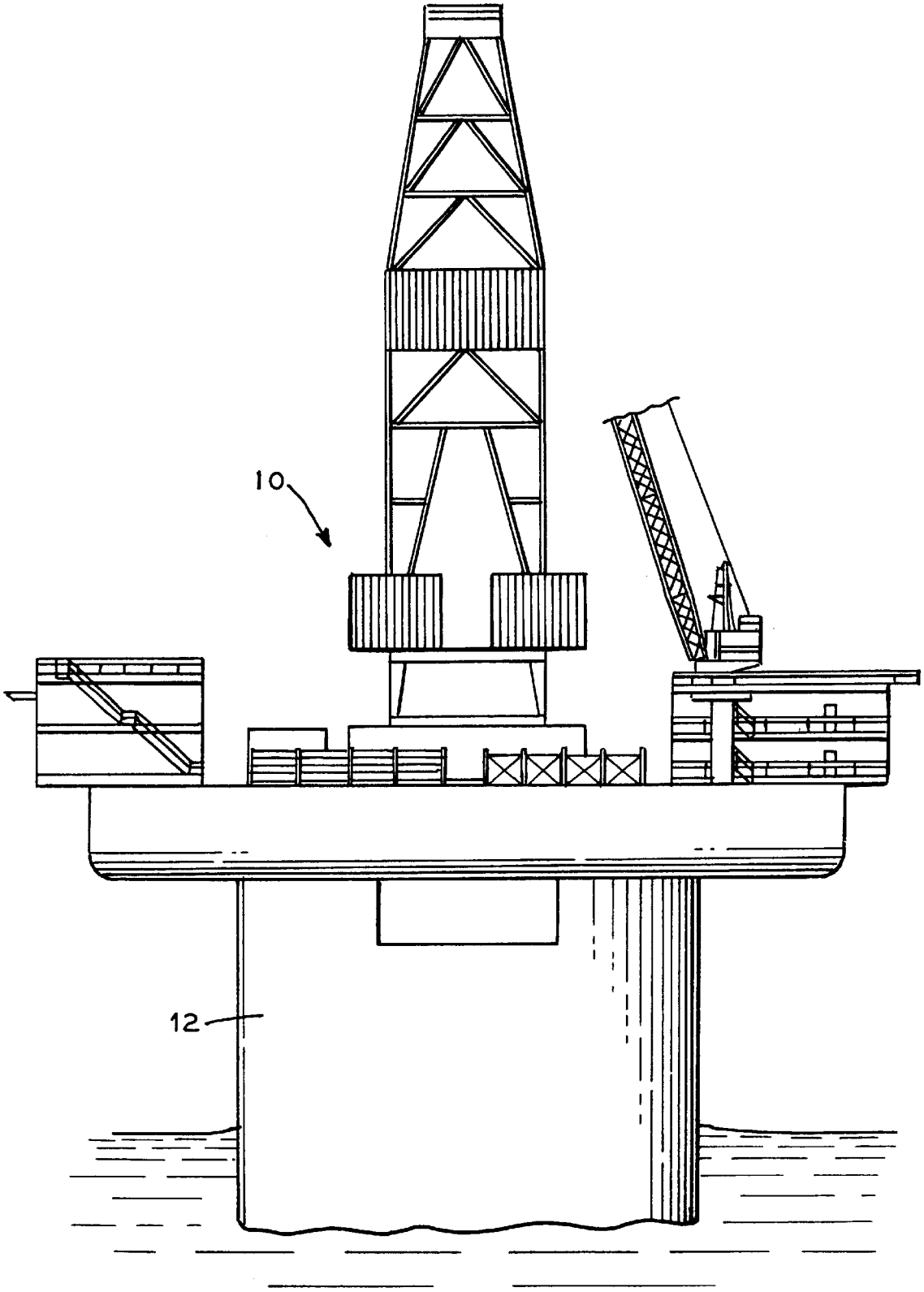
FIG. 1 is a side view of a portion of a spar type hull and deck installed on the hull.
Figure 2:
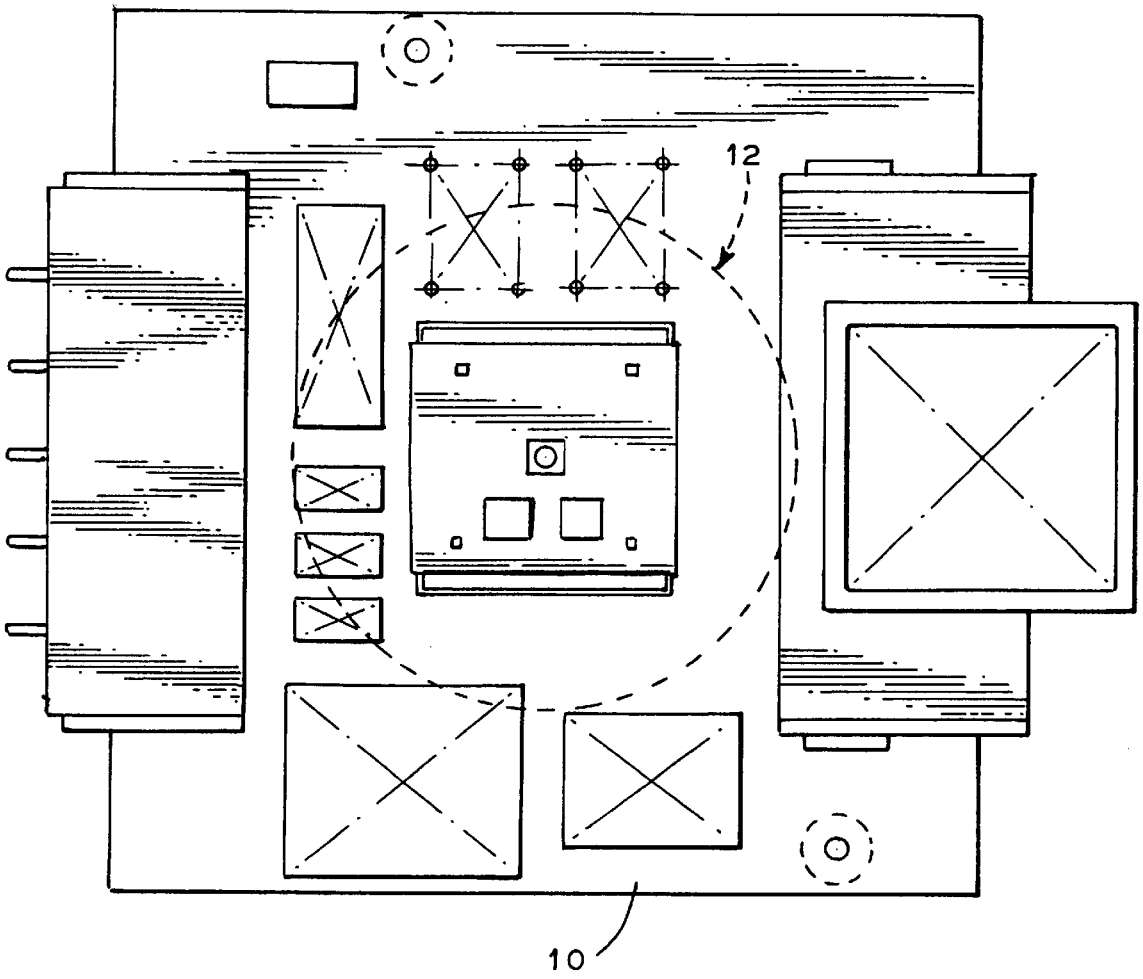
FIG. 2 is a plan view of a deck.
Figure 3:
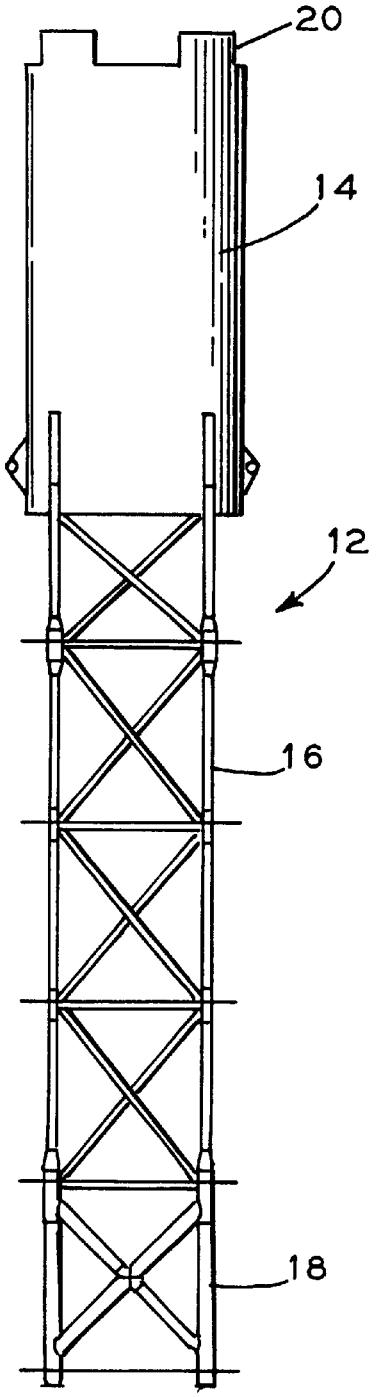
FIG. 3 is a side view of a truss spar.

FIG. 1 illustrates a deck 10 on a buoyant substructure 12 at a typical operative draft of the substructure 12. FIG. 2 is a plan view that illustrates the placement of the deck 10 on the substructure 12. FIG. 3 is a side view of a substructure 12 in the form of a jacket or truss spar such as that described in U.S. Pat. No. 5,558,467. The use of a jacket or truss spar in the drawings and description is for ease of reference in describing the invention and it should be understood that the invention is suitable for use in any type of buoyant substructure and should not be limited to the substructure illustrated and described.

It can be seen in FIG. 3 that substructure 12 is generally formed from an upper cylindrical hard tank section 14, a middle truss section 16, and a lower section 18 designed to receive fixed ballast. Upper section 14 includes castellation tanks 20.

Figure 4:
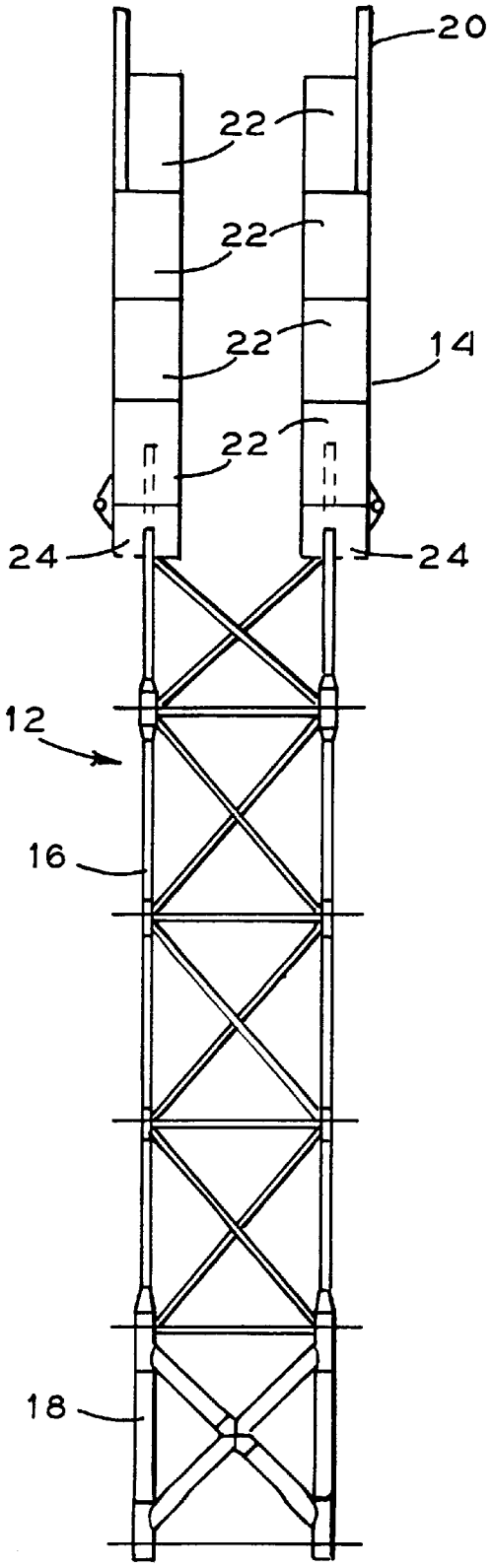
FIG. 4 is a side section view of the truss spar of FIG. 3.
Figure 5:
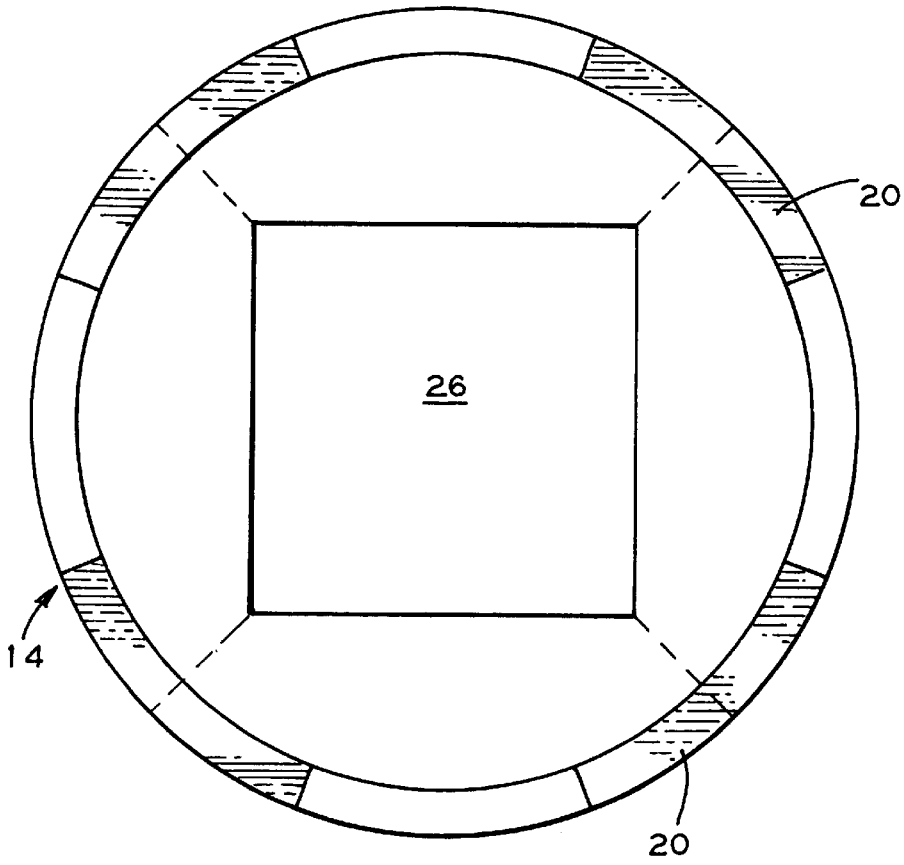
FIG. 5 is plan view of the truss spar of FIG. 3.

The section view of FIG. 4 shows that upper hard tank section 14 is divided into a plurality of hard buoyancy tanks 22 and skirt tanks 24. The top view of the substructure 12 in FIG. 5 illustrates the center well 26 that runs through the upper section 14.

Figure 6:
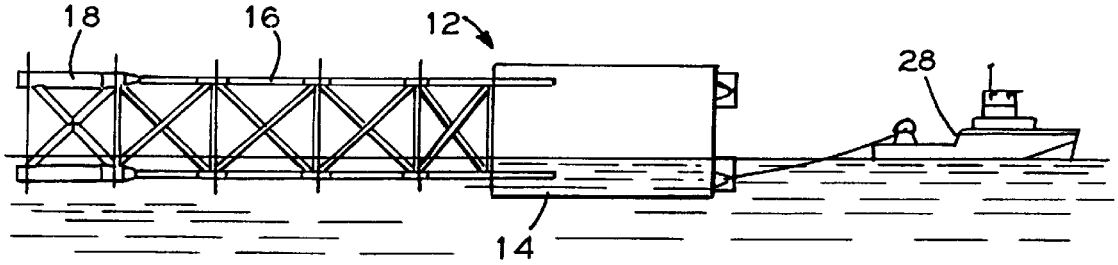
FIG. 6 illustrates the horizontal tow out of the truss spar of FIG. 3.

FIG. 6 illustrates the substructure 12, which has been towed by a tow vessel 28, in a horizontal position at an offshore site with sufficient depth to allow the substructure to be submerged to allow the deck 10 to be floated over the substructure 12.

Figure 7:
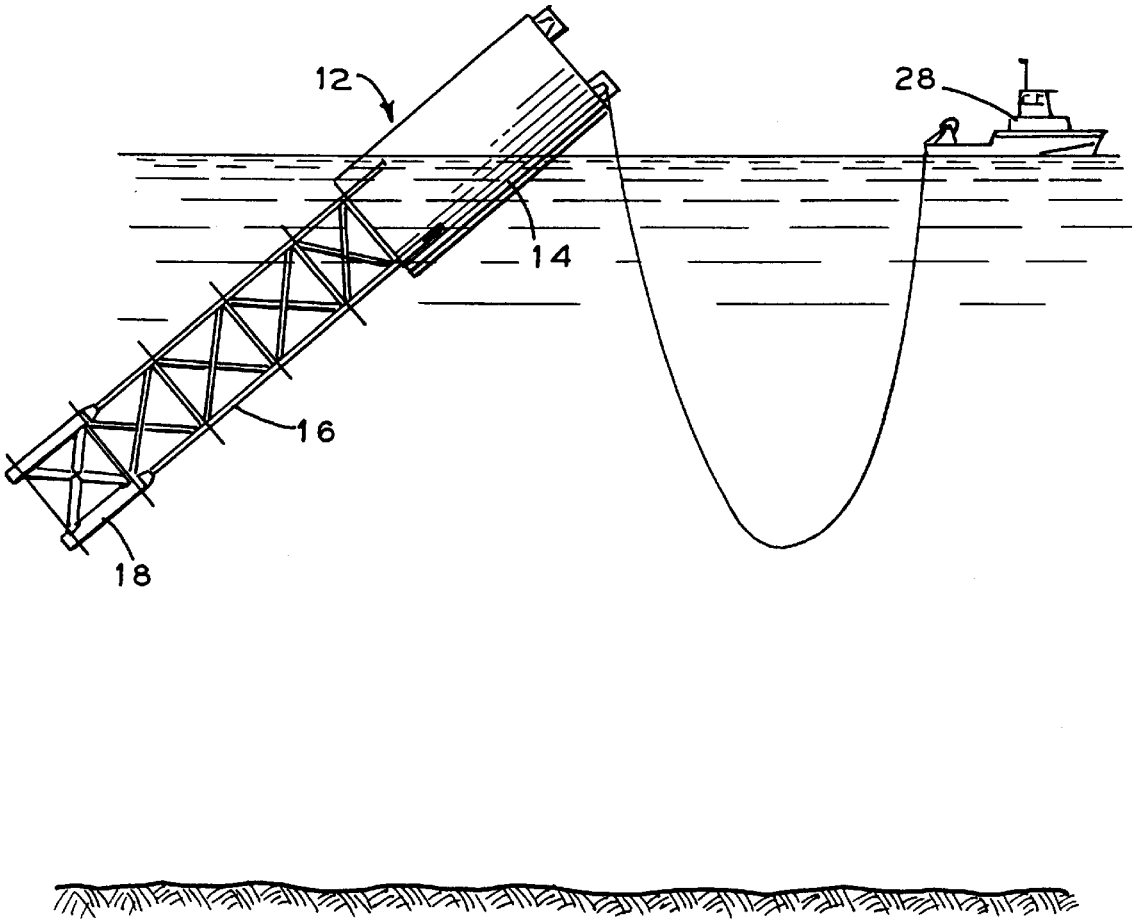
FIG. 7 illustrates the upending of the spar of FIG. 3.

FIG. 7 illustrates the substructure 12 being upended at the offshore site by flooding the lower section 18 and selected hard buoyancy tanks 22 in the lower portion of the upper tank section 14. This positions the substructure 12 in its normal operational orientation as seen in FIG. 8.

Figure 8:
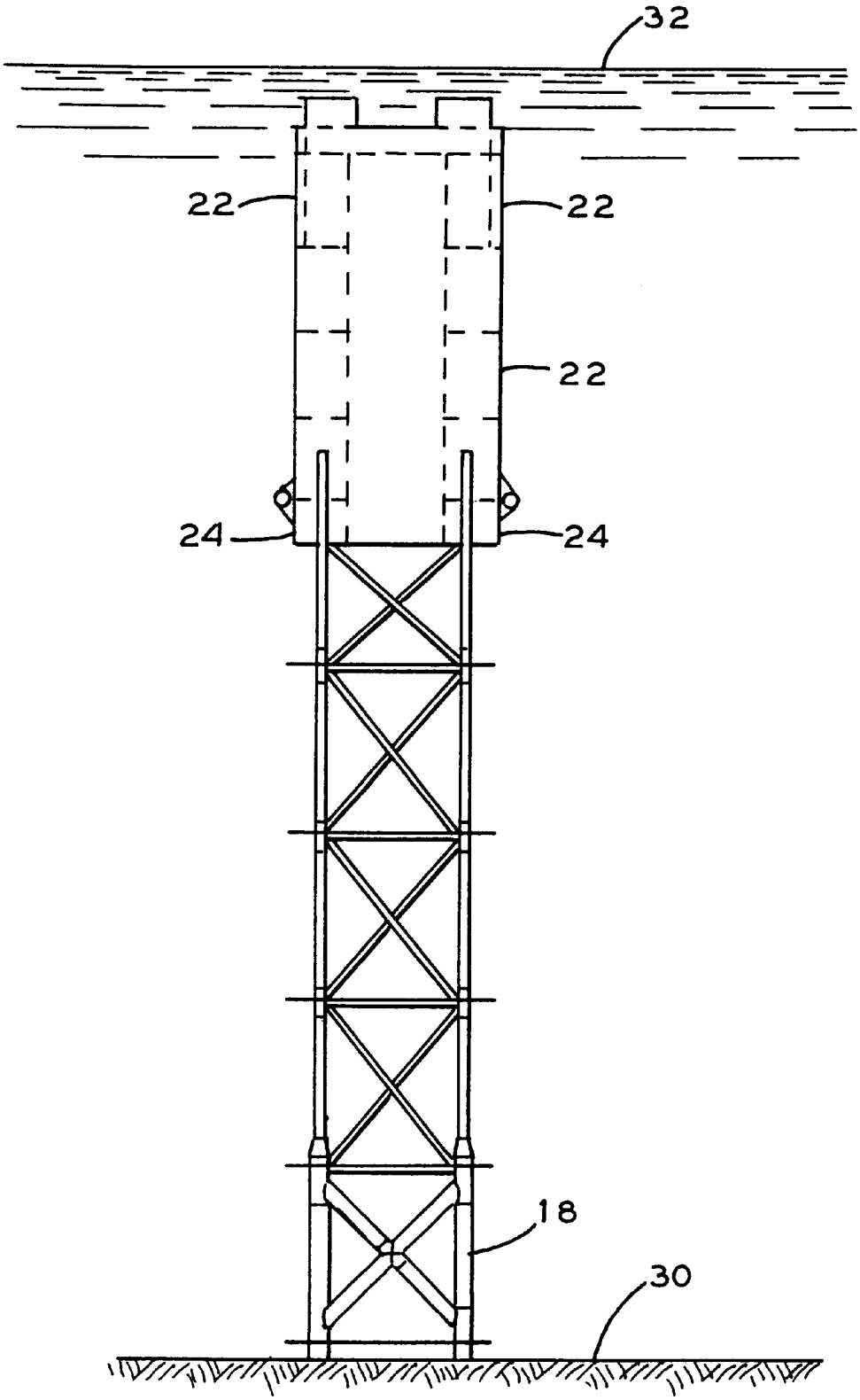
FIG. 8 illustrates the step of submerging the truss spar once it has been upended.

In FIG. 8, selected hard buoyancy tanks 22 have been filled with sea water until the substructure 12 is submerged below the water surface 32 and it is negatively buoyant and rests on the sea floor 30 with a predetermined weight. However, it should be understood that the substructure 12 is designed with sufficient buoyancy to eliminate the need for it to rest on the sea floor during installation. The most critical point is that the substructure 12 is sufficiently ballasted so that the upper end of substructure 12 is below and near the water surface 32.

Figure 9:
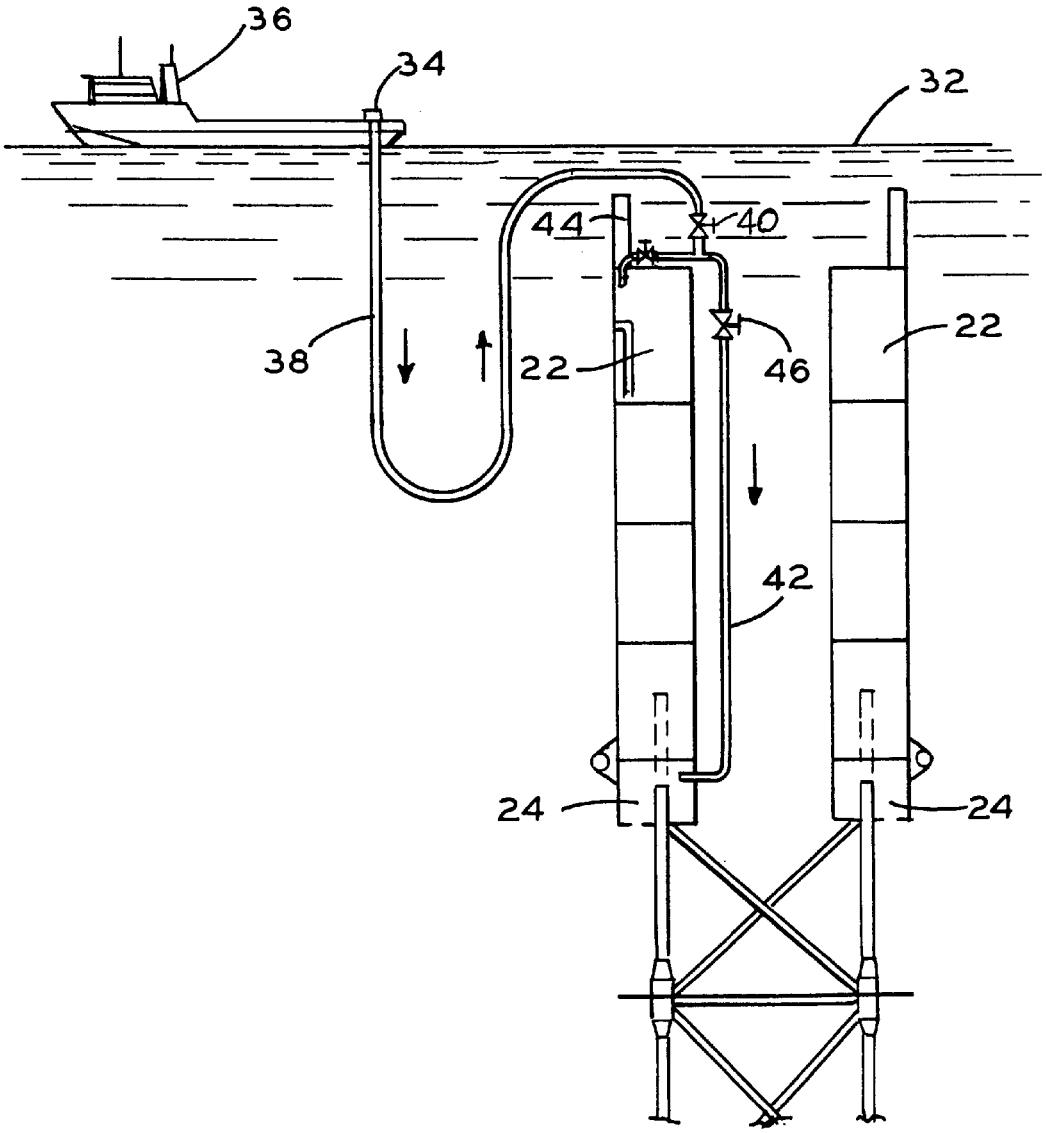
FIG. 9 illustrates the step of pumping air into the lower tanks of the truss spar.

In FIG. 9, a predetermined quantity of compressed air is pumped into and stored in the skirt tanks 24. The quantity of compressed air is an amount that will provide sufficient buoyancy to lift the substructure 12 and deck 10 to a level where both will act as one body once the lift operation starts. The skirt tanks 24 are charged with compressed air by the compressors 34 on the support vessel 36. The air is pumped from the compressors 34 through the hose 38, which is connected to first valve 40 on piping 42. During this operation, second valve 44 is closed and third valve 46 is open to direct the compressed air into the skirt tanks. The air pressure in the skirt tanks 24 is approximately equal to the ambient pressure at the depth of the skirt tanks.

Figure 10:
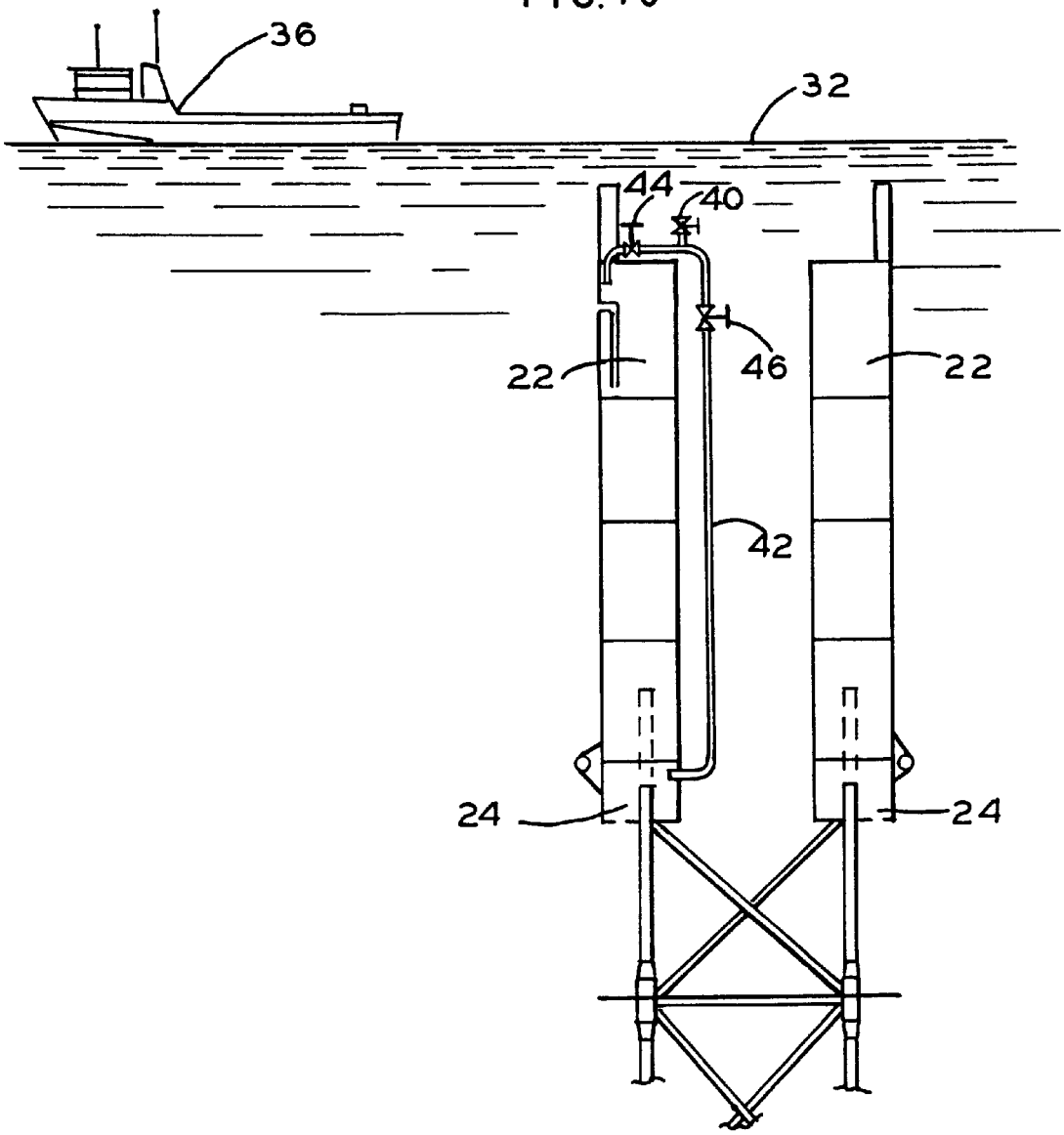
FIG. 10 illustrates the truss spar once the air filling operation is complete.

In FIG. 10, the air filling operation into the skirt tanks 24 has been completed, first valve 40 has been closed, and hose 38 has been disconnected.

Figure 11:
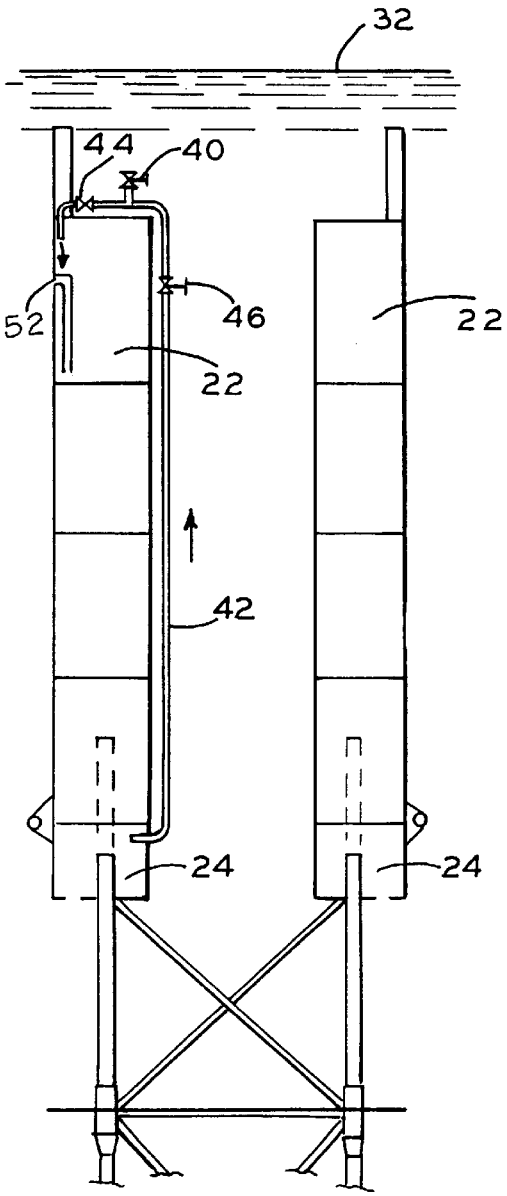
FIG. 11 is an enlarged view that illustrates the step wherein compressed air is released from the lower tanks to the upper tanks for deballasting.

FIG. 11 illustrates the lift operation. Second and third valves 44 and 46 are opened. This allows compressed air from the skirt tanks 24 to flow through piping 42 into the upper hard buoyancy tanks 22. The air displaces the water in the tanks out to sea through opening 52. The displacement of water increases the buoyancy of the substructure 12 and causes it to move upward toward the deck 10.

Figure 12:
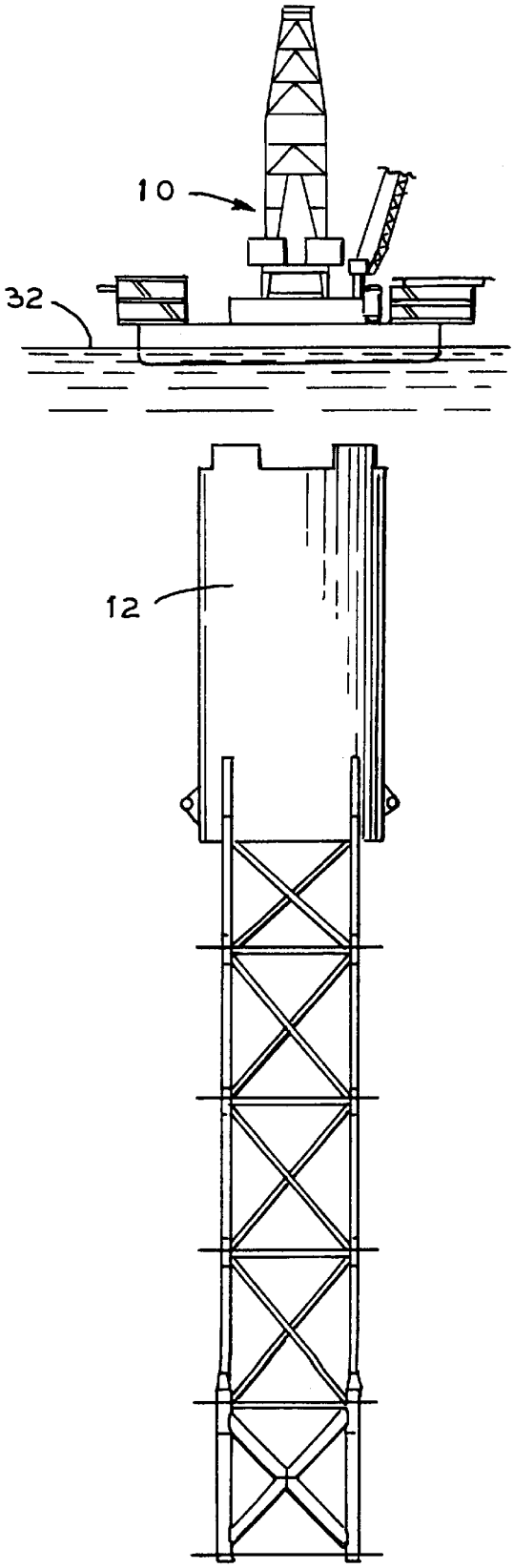
FIG. 12 illustrates the movement of the spar toward the deck during deballasting.

FIG. 12 illustrates the relative positions of the deck 10 and substructure 12 at the beginning of the lift operation. The deck 10 is positioned above and aligned with the substructure 12 for mating as the substructure rises into contact with the deck 10.

Figure 13:
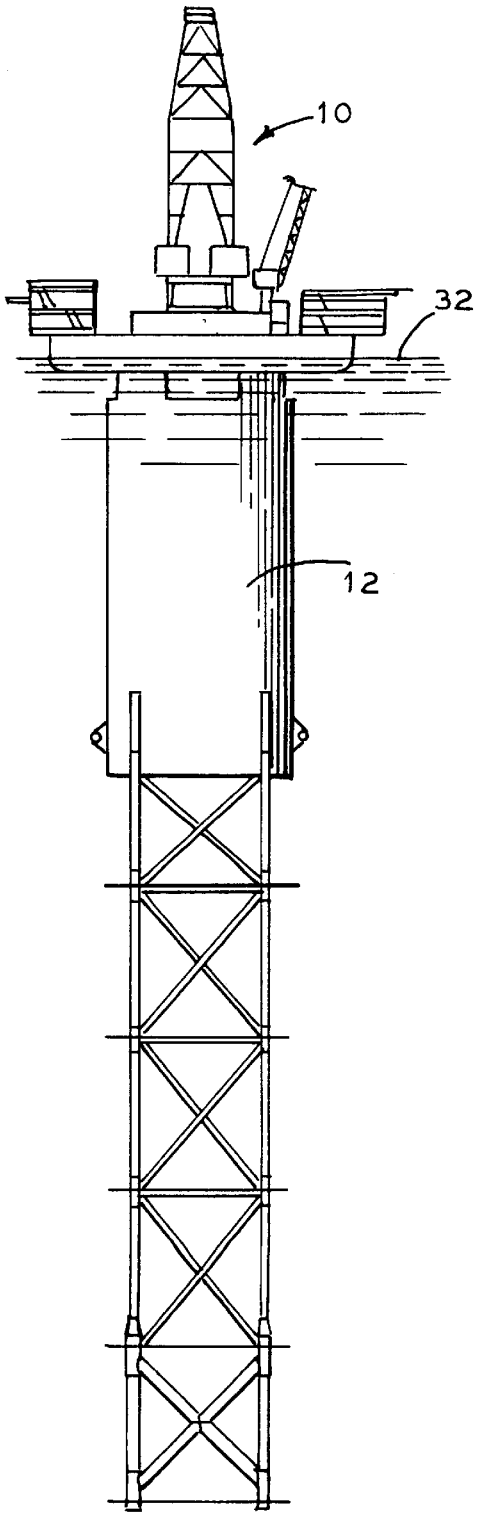
FIG. 13 illustrates contact between the spar and deck during deballasting.

FIG. 13 illustrates the contact of the substructure 12 with the deck 10. As the lifting process continues, the deck and substructure will eventually act as one body in response to wave motions. Depending upon the size and weight of the deck and substructure, this may be when approximately one to two thousand tons of water have been displaced from the upper hard tanks 22. Although water will be entering the skirt tanks 24 after a certain volume of compressed air has been released into the upper hard tanks 22, there is still a net gain in buoyancy of the substructure 12 due to the difference in pressure of the upper hard tanks 22 and the skirt tanks 24.

Figure 14:
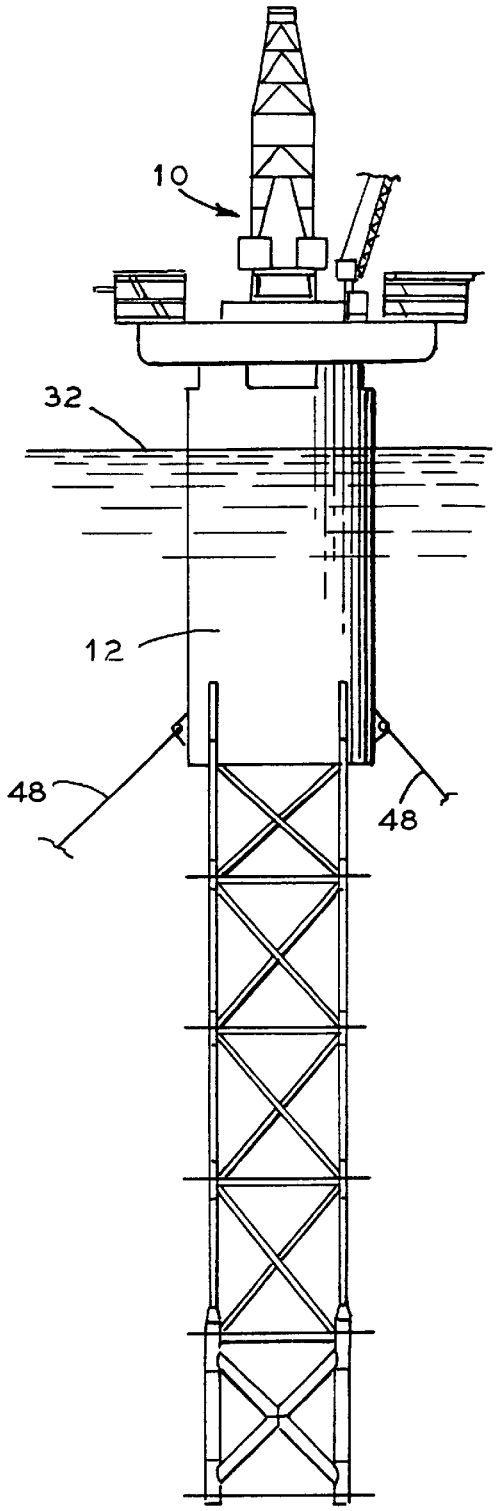
FIG. 14 illustrates the operative draft position of the spar and deck.

The initial stage of having the substructure 12 contact and lift the deck 10 so that both act as one body is the most important and must be done relatively quickly to prevent relative movement between them and potential damage to the two structures. Once the initial stage of lifting the deck 10 is sufficient to have the two bodies acting as one, the lifting operation continues until the deck has reached its operational height as seen in FIG. 14. This continued operation can incorporate a higher volume of stored compressed air during the charging phase or by injecting additional air into selected hard tanks 22 to displace water or by pumping ballast directly over board.

Figure 15:
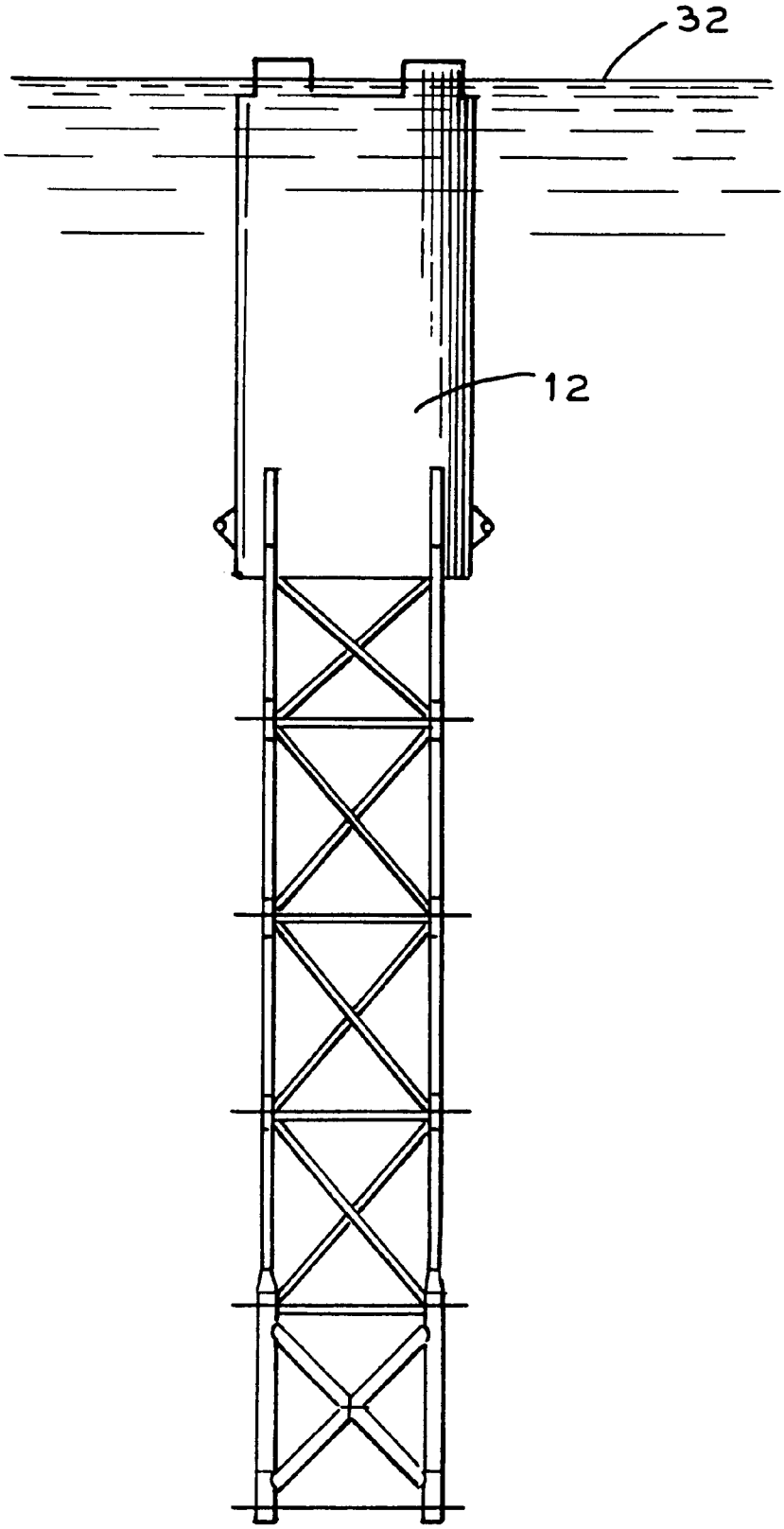
FIGS. 15–18 illustrate an alternate method of positioning the deck above the spar structure.
Figure 16:
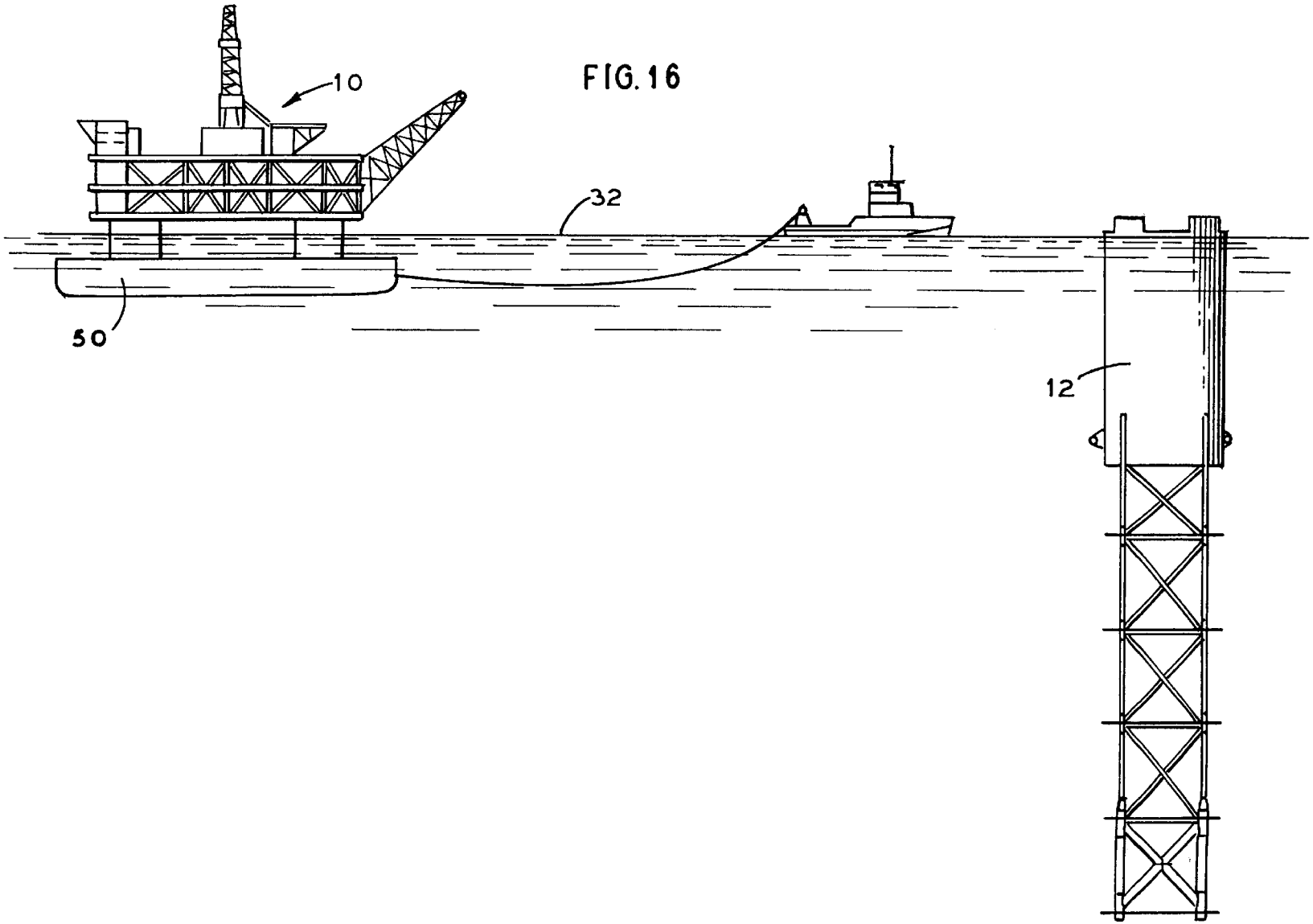
Figure 17:
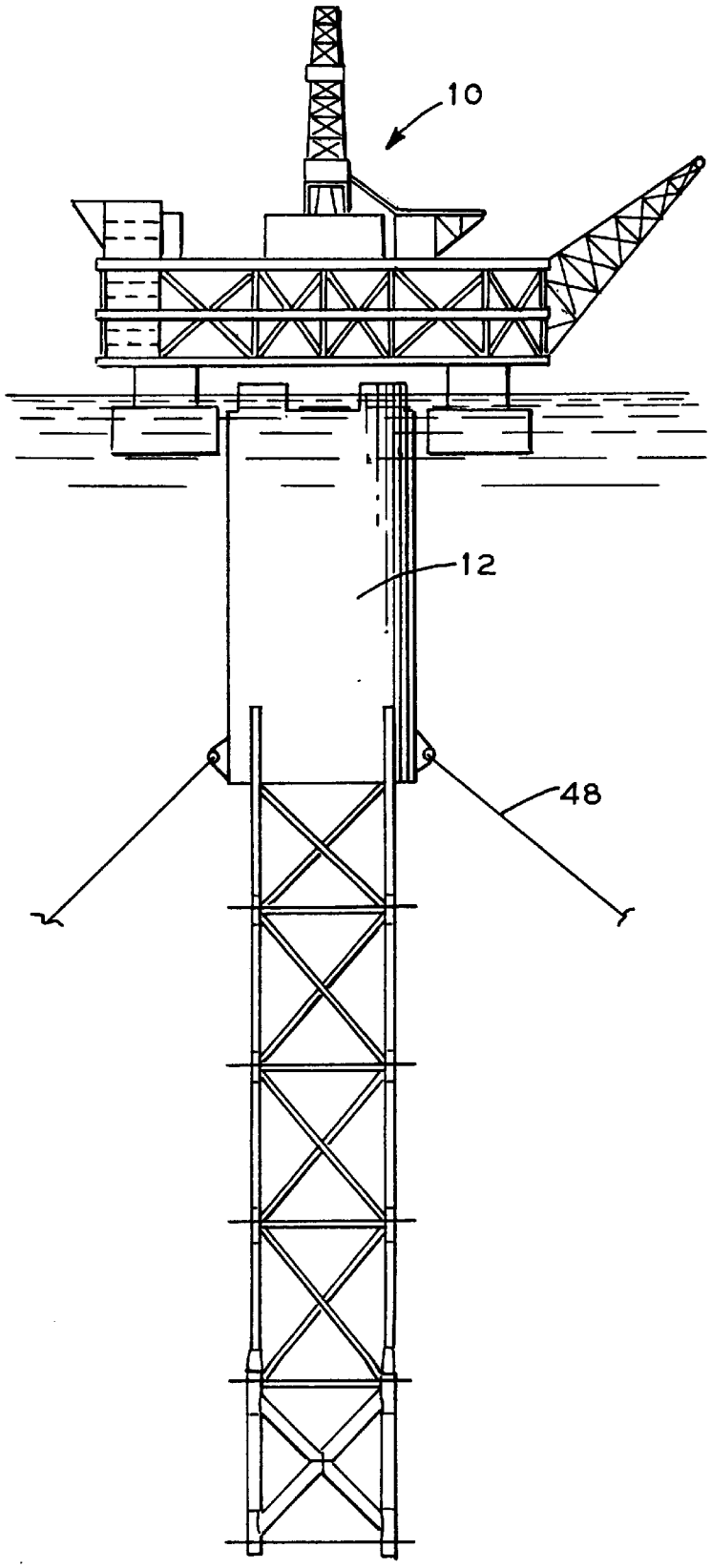
Figure 18:
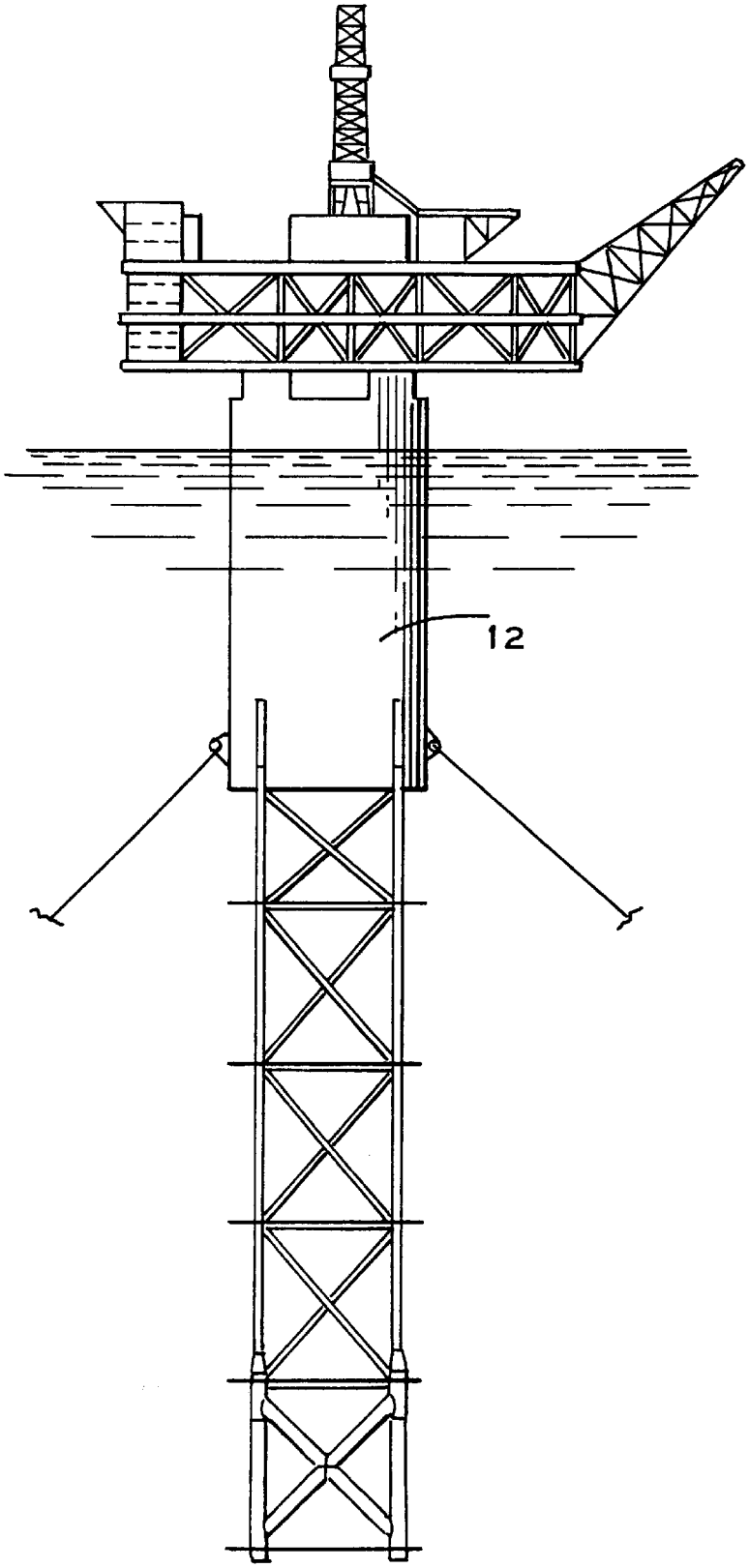

FIGS. 15–18 illustrate an alternate method of positioning the deck 10 over the buoyant substructure 12. In FIG. 15, the buoyant substructure 12 has been ballasted so that the top of the substructure is above and near the water surface 32. In FIG. 16, the deck 10 is supported on pontoons 50 and towed to the installation site. In FIG. 17, the deck 10 is positioned over the buoyant substructure 12 with the pontoons 50 straddling the buoyant substructure 12. In FIG. 18, the buoyant substructure 12 has been deballasted using the stored air as described above to engage the deck 10 with the substructure 12.

Since the completed structure is a buoyant floating structure, mooring lines 48 may be used to anchor the structure in the desired location over the sea floor.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for mating a deck onto a buoyant substructure in a marine environment, comprising:

a. positioning the buoyant substructure so as to be in its normal operational orientation;

b. ballasting the substructure so that the upper end of the substructure is below and near the water surface;

c. charging a first set of tanks in the substructure with a predetermined quantity of compressed air, said first set of tanks being open to the sea so that, as the compressed air is transferred to a second set of tanks, the pressure in said first set of tanks remains nearly constant;

d. floating and positioning the deck to be mated to the substructure above the substructure and in alignment therewith; and e. directing the compressed air from the first set of tanks to said second set of tanks in the substructure, said second set of tanks containing water such that the compressed air displaces the water from the second set of tanks, thereby increasing the buoyancy of the substructure and bringing it into contact with the deck.

2. The method of claim 1, wherein said first set of tanks is positioned below said second set of tanks on said substructure.

3. The method of claim 1, wherein the pressure of the compressed air in the first set of tanks is approximately equal to the ambient pressure on the first set of tanks.

4. In a buoyant substructure designed to float above the sea floor and be mated to and support a deck above the water surface, the improvement comprising:

a. a first set of tanks designed to receive and store a predetermined quantity of compressed air, said first set of tanks being open to the sea so that, as the compressed air is removed from said first set of tanks, the pressure in said first set of tanks remains nearly constant;

b. a second set of tanks designed to selectively receive or expel water; and c. means for directing the compressed air stored in said first set of tanks into said second set of tanks, thereby displacing water in said second set of tanks and increasing the buoyancy of said substructure.

5. A method for mating a deck onto a buoyant substructure in a marine environment, comprising:

a. positioning the buoyant substructure so as to be in its normal operational orientation;

b. ballasting the substructure so that the upper end of the substructure is above and near the water surface;

c. charging a first set of tanks in the substructure with a predetermined quantity of compressed air, said first set of tanks being open to the sea so that, as the compressed air is transferred to a second set of tanks, the pressure in said first set of tanks remains nearly constant;

d. positioning the deck to be mated to the substructure above the substructure and in alignment therewith; and e. directing the compressed air from the first set of tanks to said second set of tanks in the substructure, said second set of tanks containing water such that the compressed air displaces the water from the second set of tanks, thereby increasing the buoyancy of the substructure and bringing it into contact with the deck.

* * * * *